US009138025B1

(12) United States Patent
Lunsford

(10) Patent No.: US 9,138,025 B1
(45) Date of Patent: Sep. 22, 2015

(54) HEADGEAR

(75) Inventor: Lisa Lunsford, Olney, TX (US)

(73) Assignee: SASSA Innovations, LLC, Olney, TX (US)

( * ) Notice: Subject to any disclaimer, the term of this patent is extended or adjusted under 35 U.S.C. 154(b) by 98 days.

(21) Appl. No.: 13/217,798

(22) Filed: Aug. 25, 2011

Related U.S. Application Data

(60) Provisional application No. 61/419,167, filed on Dec. 2, 2010.

(51) Int. Cl.

| | |
|---|---|
| ***A42B 5/00*** | (2006.01) |
| ***A45D 24/00*** | (2006.01) |
| ***A42B 1/04*** | (2006.01) |
| ***A41D 23/00*** | (2006.01) |
| *A45D 8/00* | (2006.01) |

(52) U.S. Cl.
CPC ..... *A42B 1/041* (2013.01); *A41D 23/00* (2013.01); *A42B 1/04* (2013.01); *A45D 8/00* (2013.01)

(58) Field of Classification Search
CPC ..... A41D 23/00; A41D 2023/002; A41D 2023/004; A41D 2023/006; A41D 2023/008; A41D 2033/002; A41D 2033/004; A41D 2033/006; A41D 2033/008; A45D 8/00; A45D 8/34; A45D 8/36; A45D 8/38; A45D 19/14; A42B 1/041; A42B 1/04; A42B 1/043; A42B 1/045; A42B 1/046; A42B 1/048
USPC ..... 2/207, 59, 171, 174, 175.1, 195.8, 202, 2/203, 206, 208; 132/273
See application file for complete search history.

(56) References Cited

U.S. PATENT DOCUMENTS

| | | | | | |
|---|---|---|---|---|---|
| 2,191,589 | A | * | 2/1940 | Sacks | 2/174 |
| 2,831,197 | A | * | 4/1958 | Spells | 2/203 |
| 3,268,913 | A | * | 8/1966 | Gettinger | 2/171 |
| 3,327,720 | A | * | 6/1967 | Carmony et al. | 132/274 |
| 4,656,671 | A | * | 4/1987 | Manges | 2/174 |
| 5,007,115 | A | * | 4/1991 | Denbow et al. | 2/208 |
| 5,099,865 | A | * | 3/1992 | Flannery et al. | 132/212 |
| 5,566,689 | A | * | 10/1996 | Yeater | 132/212 |
| 5,621,920 | A | * | 4/1997 | Gorsuch et al. | 2/195.8 |
| 5,878,756 | A | * | 3/1999 | Bilodeau | 132/274 |

(Continued)

FOREIGN PATENT DOCUMENTS

| | | | |
|---|---|---|---|
| GB | 2434096 | A * | 7/2007 |
| WO | WO 0249469 | A2 * | 6/2002 |

OTHER PUBLICATIONS

NPL—"Oola Twi'Lek—Asha Tank—performance artiste" URL: <www.ashatank.co.uk/performer/oola.html>.*

(Continued)

*Primary Examiner* — Alissa L Hoey
*Assistant Examiner* — Jameson Collier
(74) *Attorney, Agent, or Firm* — Fish & Richardson P.C.

(57) ABSTRACT

A head covering made from a stretchable fabric forming an elongated tubular shaped article. The head covering has a front opening with a band portion to secure the head covering to a head. The head covering securely extends around the head and extends the full length of the hair to a back opening. The head covering is designed to circumferentially surround fully extended hair along the entire length of the hair. The head covering is designed to permit configuration flexibility, allowing it to protect hair, prevent user distraction from blowing hair, and permit for the safe wearing of a head apparatus.

11 Claims, 9 Drawing Sheets

(56) References Cited

U.S. PATENT DOCUMENTS

| | | | | |
|---|---|---|---|---|
| 5,974,586 | A * | 11/1999 | Reinoso | 2/16 |
| 6,640,342 | B2 * | 11/2003 | Dixon | 2/171 |
| D482,843 | S | 12/2003 | Burnett | |
| 6,665,876 | B1 * | 12/2003 | Newman | 2/59 |
| 6,735,783 | B2 | 5/2004 | Phillips | |
| 6,738,986 | B1 | 5/2004 | Martin | |
| 6,948,190 | B2 * | 9/2005 | McGreggor | 2/202 |
| 7,096,510 | B2 | 8/2006 | Yeadon | |
| D572,879 | S | 7/2008 | Marquardt | |
| 7,412,729 | B1 | 8/2008 | McGovern | |
| D624,284 | S | 9/2010 | Creel | |
| D641,140 | S * | 7/2011 | Clarke | D2/867 |
| 8,061,366 | B2 * | 11/2011 | Britton et al. | 132/200 |
| 2003/0221243 | A1 * | 12/2003 | Phillips | 2/202 |
| 2006/0179544 | A1 * | 8/2006 | Knievel | 2/181 |
| 2007/0215171 | A1 * | 9/2007 | Imazu | 132/274 |
| 2008/0222775 | A1 * | 9/2008 | DaCruz | 2/174 |
| 2009/0151048 | A1 * | 6/2009 | Laury | 2/202 |
| 2009/0293177 | A1 * | 12/2009 | Adkins | 2/171 |
| 2010/0064418 | A1 * | 3/2010 | Graham | 2/206 |
| 2010/0242980 | A1 * | 9/2010 | D'Assis et al. | 132/200 |
| 2012/0079643 | A1 * | 4/2012 | Clarke | 2/171 |

OTHER PUBLICATIONS http://bikewearhouse.com/products/clif-bar-cycling-skull-cap; date of first publication unknown; date of access Apr. 19, 2011.

www.ringettestore.com/node/1927; first published Aug. 27, 2007; date of access Apr. 19, 2011.

* cited by examiner

HEADGEAR

CROSS REFERENCE TO RELATED APPLICATIONS

This application claims the benefit of U.S. Provisional Application No. 61/419,167, filed 2 Dec. 2010.

BACKGROUND

1. Field of the Invention

The present application relates generally to a head covering and, more particularly, to an article of manufacture for protecting, surrounding, and holding hair of varying lengths.

2. Description of Related Art

Head coverings have been around for many years. The term head coverings may imply fabric or textile materials, or rigid and hard materials like helmets. It is not uncommon that both types of head coverings are used at the same time. Head coverings have typically been made from a cloth or textile material that wraps around the head. These have typically protected the hair and head, to a lesser extent, from the sun and wind. A typical example would be a bandana. Bandanas are typically one sheet of material tied around a head in a particular way. Baseball caps are another more recent example. These caps may be adjustable to fit heads of different sizes typically using snaps or elastic. More recently, elastic form fitting materials have been used in products to adjust to head size variations. An example would be a skull cap. Generally, the examples illustrated above protect the head and hair immediately around the head from the sun, wind, or helmets. However, these do not generally protect long hair. An example of long hair would be hair that extends below the skull cap or baseball cap; or reaches the shoulders or lies along ones back past the waist.

In order to accommodate long hair, typically baseball caps and skull caps will contain an aperture located adjacent to the back of the head to permit long hair to protrude through. This, however, often causes the hair to be bunched tightly together in a predetermined location making for the proper wearing of form fitting helmets extremely difficult and unsafe. Furthermore, the hair remains uncovered and unprotected. Another option is to squish the hair along the neck underneath the band area. However, this allows for the cap to easily be removed from the head when the hair extending from the cap is pulled upward either intentionally or unintentionally.

Furthermore, some head coverings incorporate the use of a bag or pouch. Such bags or pouches may be limited in size and length and may only allow hair to be gathered in one location. In order to secure the hair inside the bag or pouch, ties may be used. Typically these bags or pouches have only one opening, being fully closed on the opposite end. Depending on the length of hair, hair is often bundled or pulled up in order to rest inside the bag or pouch. For people with longer or thicker hair, such pouches or bags may be too small.

Although protecting long hair, the gathered hair in bags or pouches may not adequately allow for the safe and secure wearing of a helmet or other head covering at the same time. Hair bunched up can interfere with how a helmet securely rests on a head, thereby affecting the user's comfort and the helmet's ability to protect the head. A similar affect is seen with such skull caps having an aperture for long hair. The hair is tightly gathered, often in a ponytail, creating interference with the helmet on a user's head. Ties used around the pouch or bag may also interfere with a helmet. Ties may also loosen over time allowing the hair to come free and exit the bag or pouch. If hair is left uncovered or exits the bag or pouch when wearing a helmet, the hair may blow into the face of the user causing a distraction or worse yet, an accident. Hair may also become entangled and pulled from the head.

Although great strides have been made in head coverings, considerable shortcomings remain.

DESCRIPTION OF THE DRAWINGS

The novel features believed characteristic of the application are set forth in the appended claims. However, the application itself, as well as a preferred mode of use, and further objectives and advantages thereof, will best be understood by reference to the following detailed description when read in conjunction with the accompanying drawings, wherein:

Figure 1:
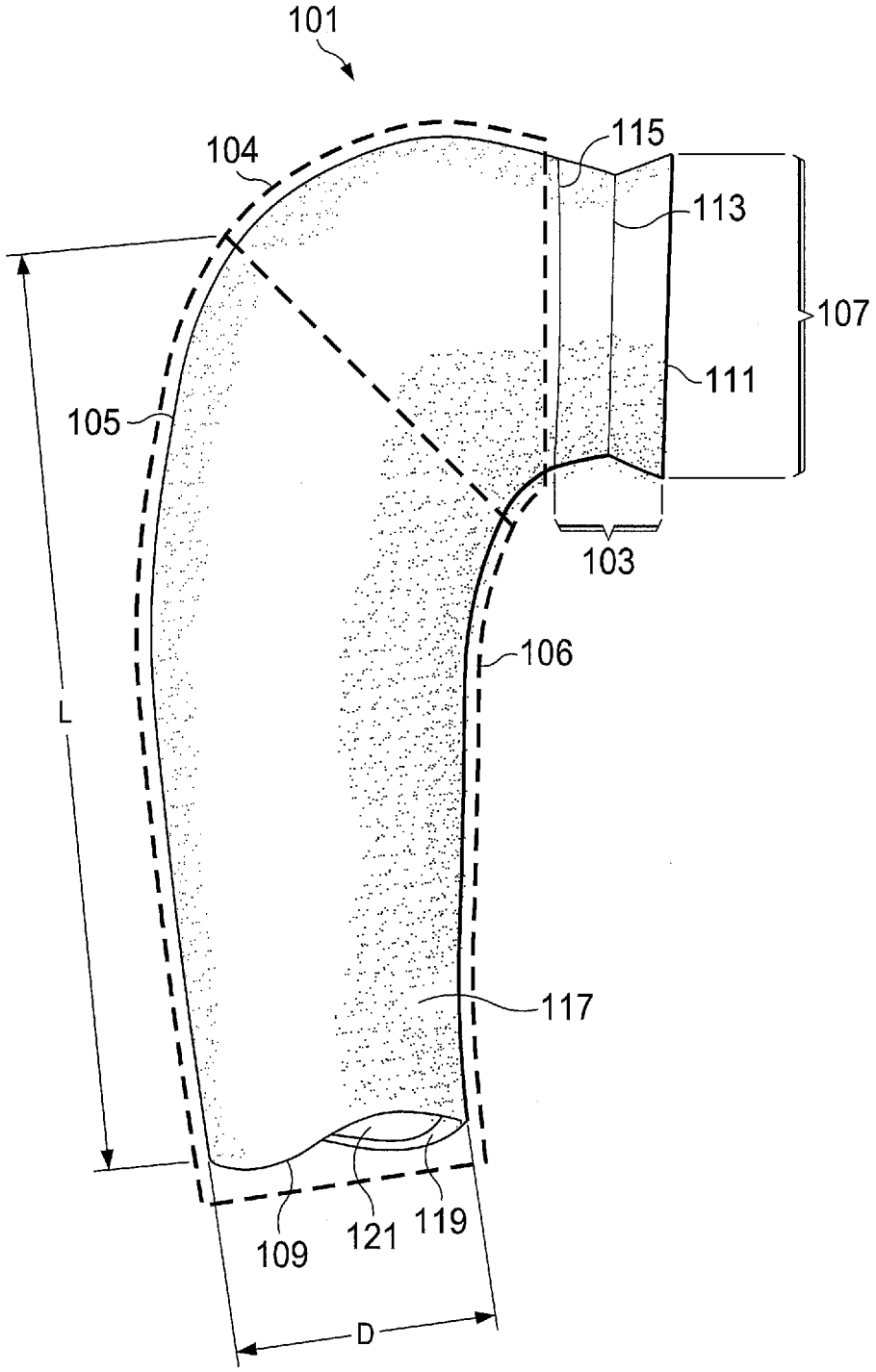
FIG. 1 is a side view of a headgear according to the preferred embodiment of the present application, wherein a band portion is unfolded for illustration purposes.

While the system and method of the present application is susceptible to various modifications and alternative forms, specific embodiments thereof have been shown by way of example in the drawings and are herein described in detail. It should be understood, however, that the description herein of specific embodiments is not intended to limit the application to the particular embodiment disclosed, but on the contrary, the intention is to cover all modifications, equivalents, and alternatives falling within the spirit and scope of the process of the present application as defined by the appended claims.

DETAILED DESCRIPTION OF THE PREFERRED EMBODIMENT

Referring to FIGS. 1, 2, 3, and 4 in the drawings, side and quartering views of a headgear 101 of the present application is illustrated both on and off the head. Headgear 101 is a tubular shaped head covering having a varying cross-sectional diameter with two open ends: a front opening 107 and a back opening 109. Headgear 101 has a band portion 103 and an elongated hair covering 105. Headgear 101 slides on and around a user's head being configured to surround hair of any length. Although elongated hair covering 105 has been described having a tubular shape, it should be understood that elongated hair covering 105 may take the form of any shape.

Headgear 101 is preferably made out of stretchable fabric including but not limited to any of the following such as stretch spandex, nylon, or polyurethane to name a few. The fabric permits headgear 101 to stretch to multiple shapes and sizes, thereby allowing headgear 101 to securely fit a variety of head sizes.

Figure 3:
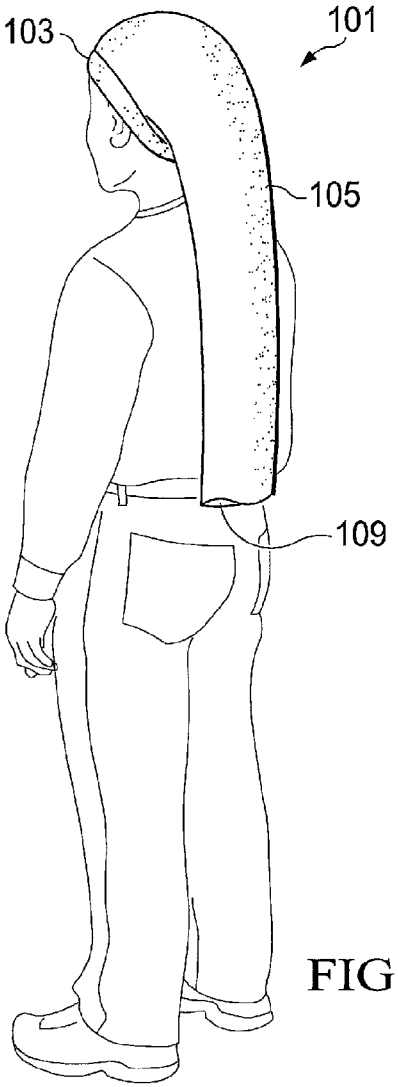
FIG. 3 is a back quartering view of the headgear of FIG. 2 wherein the headgear has a longer length.
Figure 2:
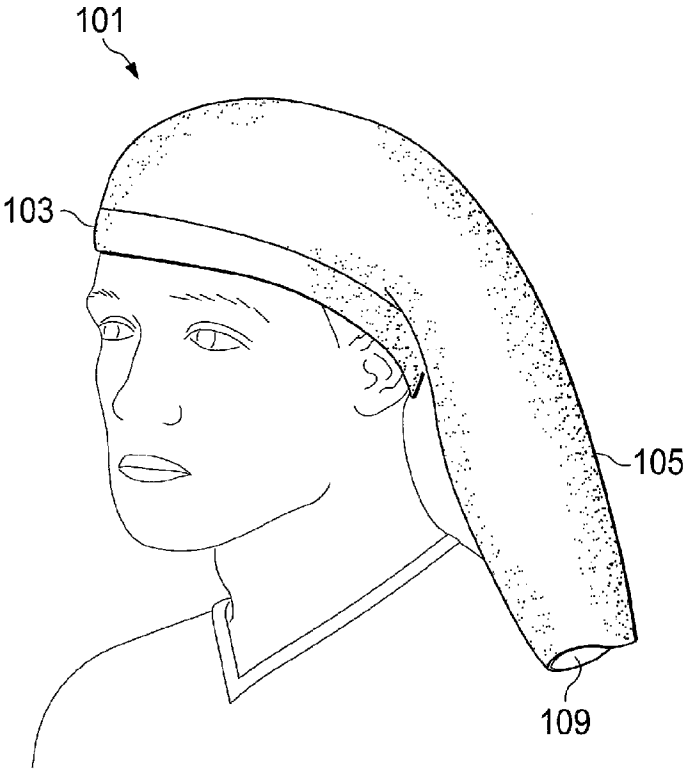
FIG. 2 is a front quartering view of the headgear of FIG. 1 worn on a human head.

Typically two pieces of fabric are used to form headgear 101. The fabric is cut out in a shape similar to that of FIG. 1 and sewn together along its length. However, it is understood that headgear 101 is not limited to the shape depicted. Headgear 101 may be cut out in any other shape that permits headgear 101 to perform as described. Band portion 103 is located at front opening 107 of headgear 101. Band portion 103 is tailored to securely fit around the forehead, over the ears, and along the lower head below the hair line as seen in FIGS. 2 and 3. Elongated hair covering 105 typically has a head portion 104 and a tail portion 106. Head portion 104 is typically the part of elongated hair covering 105 that attaches to band portion 103 and snuggly wraps around the head. Tail portion 106 typically extends from head portion 104, away from band 103, toward back opening 109. Tail portion 106 is generally configured to fit relatively loose around the hair.

Although the preferred embodiment of elongated hair covering 105 has both head portion 104 and tail portion 106, it is understood that elongated hair covering 105 may omit either portion 104, 106. For example, elongated hair covering 105 may include tail portion 106 only. In this configuration, tail portion 106 would attach to band portion 103 and relatively loosely surround the head and extend down the back and neck thereby completely surrounding the hair. This configuration performs similarly to the preferred embodiment except that the relatively snug fit around the head from head portion 104 is replaced by the relatively loose fit of tail portion 106.

Figure 4:
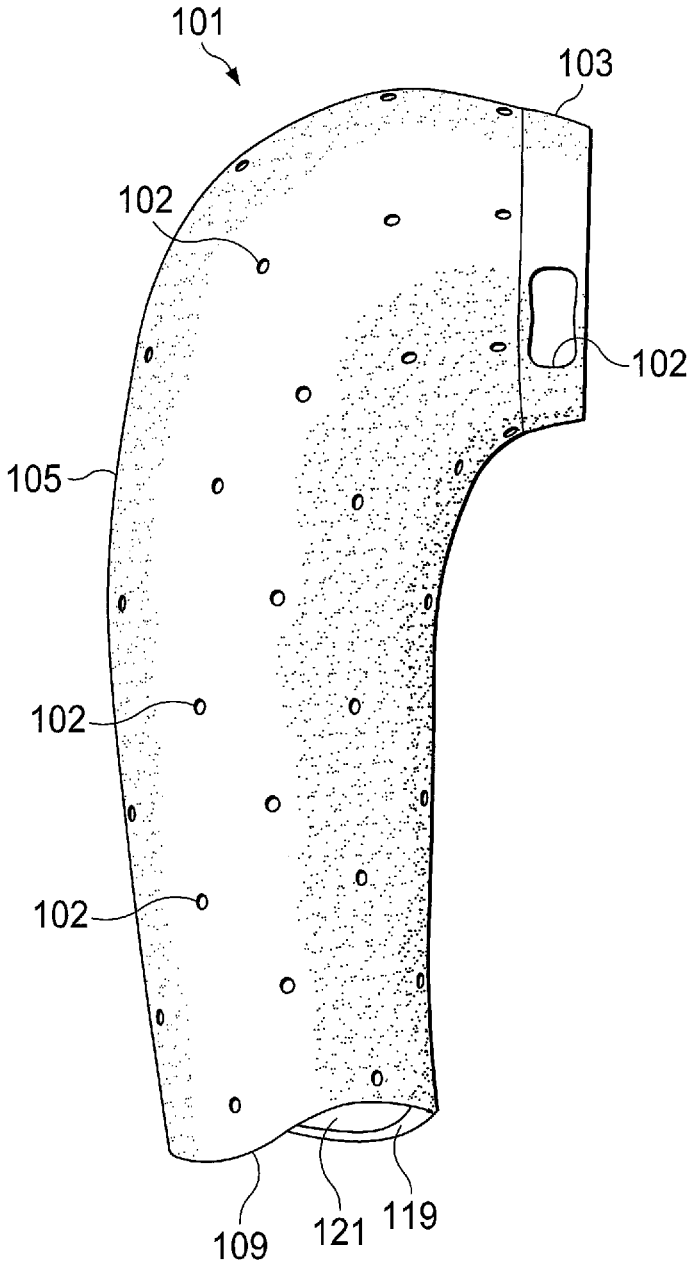
FIG. 4 is a side view of headgear of FIG. 1 having a completed band portion and side apertures.

Headgear 101 may fit over the ears as depicted in FIGS. 2 and 3, or headgear 101 may also be worn above or below the ears. Headgear 101 may include one or more body apertures 102 as seen in FIG. 4. Body apertures 102 can be any diameter and located in elongated hair covering 105 and/or band portion 103. Body apertures 102 are typically sized to permit ventilation or are sized big enough to permit things such as ears to penetrate, an increase in hearing capabilities, earrings to be worn, or ear buds from a music device to be used while wearing headgear 101.

Figure 5A:
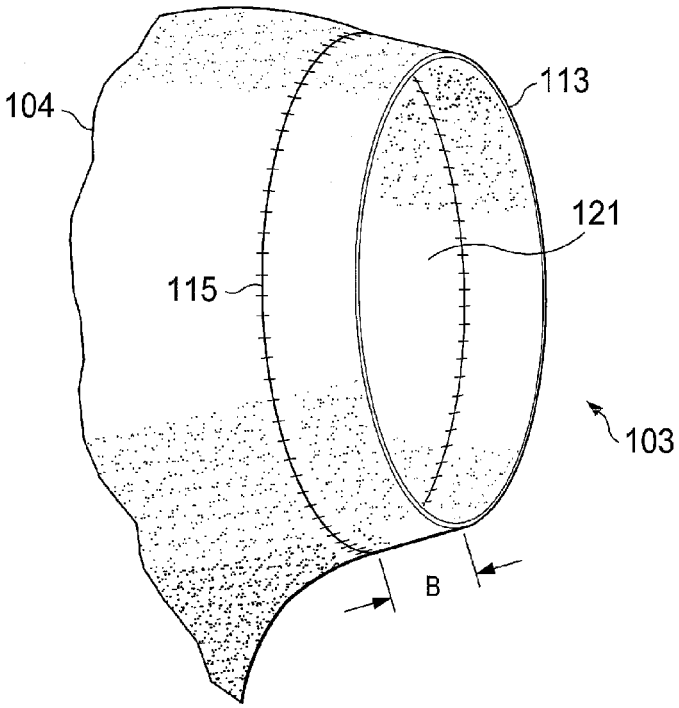
FIGS. 5A-5B are a perspective view of the band portion of FIG. 1 wherein the band portion is formed according to the preferred embodiment.
Figure 5B:
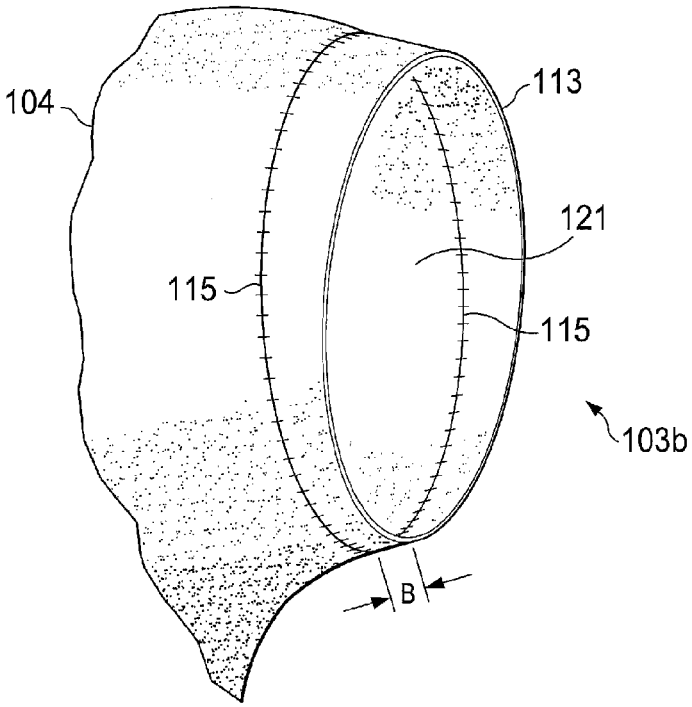

Referring now also to FIGS. 5A and 5B in the drawings, wherein band portion 103 of the preferred embodiment is illustrated. In the preferred embodiment, band portion 103 is formed from the same piece of material as elongated hair covering 105 as shown in FIG. 1. Band portion 103 is formed by folding over or under edge 111 along fold line 113. Edge 111 is then stitched all the way around the fabric creating stitch line 115. Band portion 103 therefore contains two layers of fabric. The two layers work together to increase the tension of band portion 103 around the head, thereby producing a more secure fit. Band portion 103 is the material between stitch line 115 and fold line 113 having a width B. It is preferred that band portion 103 retains a relatively constant width B uniformly around front opening 107, for example two inches. However, width B may be any desired width. A finished band portion 103, as described in the preferred embodiment, is shown in FIG. 5A.

Furthermore, band portion 103 generally has a tapered shape wherein the cross-sectional diameter along fold line 113 is smaller than the cross-sectional diameter along stitch line 115 or edge 111. The tapered shape further aids headgear 101 in remaining secure around the head. Although the preferred embodiment of band portion 103, as seen in FIG. 5A, shows a tapered cross-section, it is understood that other shapes may be used. For example, the cross-sectional diameter along fold line 113 may be equal to the cross-sectional diameter along stitch line 115 or edge 111 thereby producing no tapered shape. The shape of band portion 103 depends on several factors such as the type of fabric used and the use of additive material, discussed below, to name a few. Wherein FIG. 5A shows band portion 103 with a constant width B, it is understood that band portion 103 may vary width B around the circumference by adjusting the location of fold line 113 as seen in FIG. 5B. In FIG. 5B, band portion 103*b* is shown having width B vary around the circumference of band portion 103.

In another embodiment, band portion 103 may remain unfolded as a single layer of fabric, but include additive material near front opening 107. Additive material refers to the use of some material, whether the same or different from elongated hair covering 105, used to increase the tension in band portion 103 around the head. For example, additive material may be the same fabric used in elongated hair covering 105 but having a tighter weave resulting in a localized concentration of fabric. In another example, additive material can be a separate fabric or material incorporated into the fabric of headgear 101 such as elastic. Furthermore, an example of additive material may also be thread used with a stretch stitch, like a zigzag stitch. The stretch stitch typically permits the fabric to stretch without breaking the thread. The thread can also have a degree of elasticity such that the thread can add to the tension of band portion 103 when used in larger quantities. It is understood that additive material is not limited to use with band portion 103. Additive material may be incorporated into any portion of headgear 101. Furthermore, additive material can be used in any embodiment of band portion 103.

Referring now also to FIGS. 5C-5F, wherein multiple embodiments of band portion 103 having a tapered shape and constant width B is illustrated. These additional embodiments allow for band portion 103 to be a separate body requiring band portion 103 to be attached to elongated hair covering 105 to form headgear 101. With regards to the remaining Figures, FIGS. 5C-5F, it is understood that the limitations, features, functions, and shapes as described above regarding band portion 103 in FIGS. 5A and 5B will apply equally to the remaining embodiments described in FIGS. 5C-5F. Band portion 103, 103*b*, 103*c*, 103*d*, 103*e*, 103*f* may therefore use different fabric or material than is used for elongated hair covering 105. Examples of different material may be, but is not limited to, plastic, leather, elastic, or paper based material such as cardboard, to name a few.

Figure 5C:
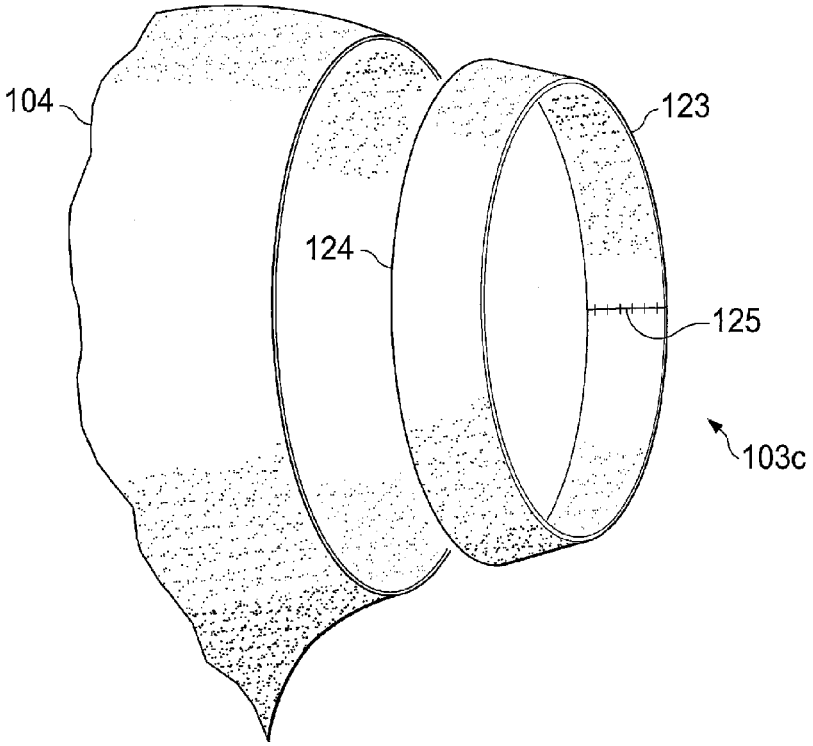
FIGS. 5C-5E are perspective views of multiple embodiments of the band portion of FIG. 5A.

FIG. 5C shows band portion 103*c* being made from a single piece of fabric having a front end 123 and a back end 124. In this embodiment, band portion 103*c* is a single layer of fabric. The narrow ends of the fabric are sewn together creating a stitch line 125. Band portion 103*c* is tapered wherein front end 123 has a cross-sectional diameter smaller than that of back end 124. Band portion 103*c* attaches to head portion 104 along back end 124.

Figure 5D:
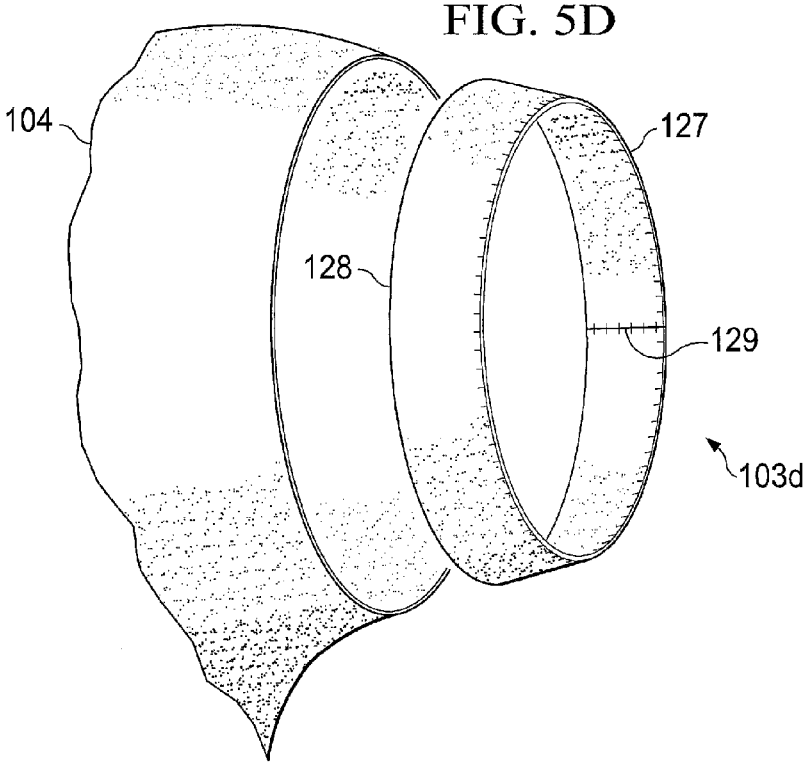

FIG. 5D shows band portion 103*d* formed from a single piece of fabric wherein the fabric is folded over creating a back end 128 and sewn together along a front end 127. Band portion 103*d* therefore has 2 layers of fabric. A stitch line 129 is used to attach the two ends of the fabric thereby forming band portion 103*d*. As illustrated, band portion 103*d* retains the tapered form describe with band portion 103, 103*c*. Band portion 103*d* attaches to head portion 104 along back end 128. Although stitch line 129 is described along front end 127, it is understood that the fabric may also be folded along front end 127 and stitched along back end 128.

Figure 5E:
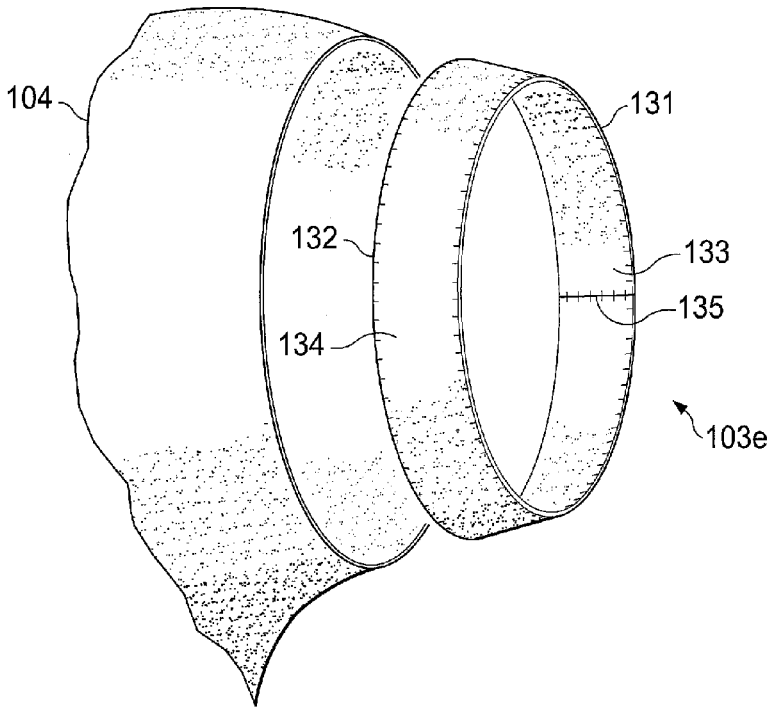

FIG. 5E shows band portion 103*e* with multiple layers of fabric. Band portion 103*e* has a front end 131 and a back end 132. Band portion 103*e* may be formed by layering multiple pieces of fabric on each other and sewing the fabric together along front end 131 and back end 132. Layering the fabric allows for different fabric to be used on inner surface 133 than is used on outer surface 134. A stitch line 135 is used to attach the two ends of the fabric thereby forming band portion 103*e*. Band portion 103*e* attaches to head portion 104 along back end 132. Although described using multiple pieces of fabric to create multiple layers in band portion 103*e*, it is understood that one piece of fabric may be used where the fabric is folded over in an "S" shape.

Figure 5F:
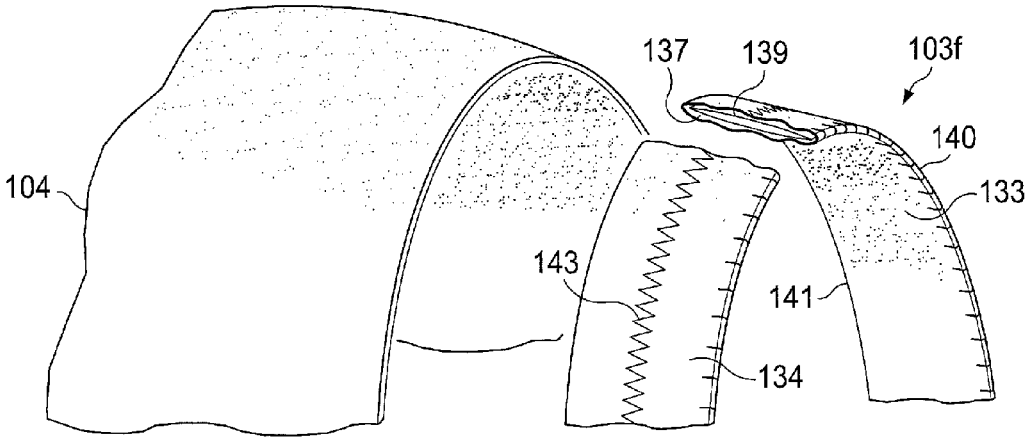
FIG. 5F is a breakout view showing a material insert in a void space of the band portion.

FIG. 5F shows an embodiment similar to that of band portion 103*d* wherein band portion 103*f* has a material insert 139 between the layers of fabric. Although FIG. 5F illustrates band portion 103*f* with material insert 139, material inserts 139 may be found in band portions 103, 103*b*, 103*d*, and 103*e* wherein more than one layer of fabric is used. Multiple layers of fabric create a void space 137 between the layers. Material insert 139 may be inserted into any void space 137 to adjust form, comfort, or function of band 103, 103*b*, 103*d*, 103*e*, 103*f*. Examples of material inserts 139 include the following but are not limited to: padding, plastic, or elastic to name a few. For example, a moisture absorbing material insert may be inserted to help prevent perspiration from dripping down the face. Material insert 139 may be attached to the fabric or be left unattached between the layers. Attaching material insert 139 to the fabric may be done along a front end 140, a back end 141, or along either surface 133, 134 as shown by a stitch line 143. Band portion 103*f* is attached to head portion 104 along back end 141. For purposes of further discussion regarding band portion 103, 103*b*, 103*c*, 103*d*, 103*e*, 103*f*; use of the term, band portion 103, will have equal applicability to all embodiments.

Although attaching band portion 103 to head portion 104 has been described by sewing material together, it is understood that other forms of attaching may be used such as, but not limited to, snaps, clips, or hook and loop-type fasteners, such as VELCRO, to name a few. Furthermore, it is understood that band portion 103*c*, 103*d*, 103*e*, 103*f* may be formed by overlaying surface 133, 134 around head portion 104 and attaching each together. Additionally, the fabric used in band portion 103, 103*c*, 103*d*, 103*e*, 103*f* can be a single piece of elastic material.

Referring back to FIGS. 1, 2, and 3, elongated hair covering 105 is tailored to protect the head from harmful environments such as cold, heat, sunburn, dust, and contaminants to name a few; and to allow various head apparatuses to be worn safely. Elongated hair covering 105 has an outer surface 117 and inner surface 119. In order to further protect the head and hair, a lining 121 can be attached to elongated hair covering 105. Headgear 101 can be used to cover and contain long hair during several activities such as sports, leisure, or occupational activities. Examples of sports activities include, but are not limited to: motorcycle riding, football, track and field sports, bicycling, soccer, volleyball, hockey, water sports, hang gliding, and target shooting to name a few. Examples of leisure activities include, but are not limited to: jogging, bicycle riding, or snowmobiling to name a few. Examples of occupational activities include, but are not limited to: surgical or medical procedures, hospital procedures, welding, cooking, serving food, cleaning, or welding to name a few. Elongated hair covering 105 generally has a tapered shape. Head portion 104 has a cross-sectional diameter which initially increases from band portion 103 but then decreases before tail portion 106. Tail portion 106 has a cross-sectional diameter that gradually decreases from head portion 104 to back opening 109. Although elongated hair covering 105 has been described as having a tapered form, it is understood that elongated hair covering 105 may take multiple shapes such as strait where the cross-sectional diameter of elongated hair covering 105 does not vary.

Head portion 104 snuggly fits around and forms to a head when worn. The volume of head portion 104 increases as needed when headgear 101 is placed on the head, permitting head portion 104 to form to the shape of the head. Furthermore, head portion 104 forms to the shape and volume of hair in any number of styles. Head portion 104 is permitted to extend from band portion 103 any distance around the head. For example, head portion 104 may extend one, three, or five inches around the head from any point on band portion 103 before tail portion 106 begins.

Tail portion 106 surrounds hair extending beyond head portion 104. Tail portion 106 has a length L so as to circumferentially surround any length of hair as the hair extends beyond head portion 104. Length L may vary, being any length. The variable lengths of head portion 104 and tail portion 106 permit elongated hair covering 105 to therefore be any length. This permits elongated hair covering 105 to vary in length and surround any length of hair. In illustrating this, FIG. 3 is another embodiment of FIG. 2 and substantially similar in form and function. Headgear 101 in FIG. 3 is structurally different in that elongated hair covering 105 is longer, extending down to the waist, thereby resulting in the taper being carried out over a longer distance to surround waist length hair.

Figure 6:
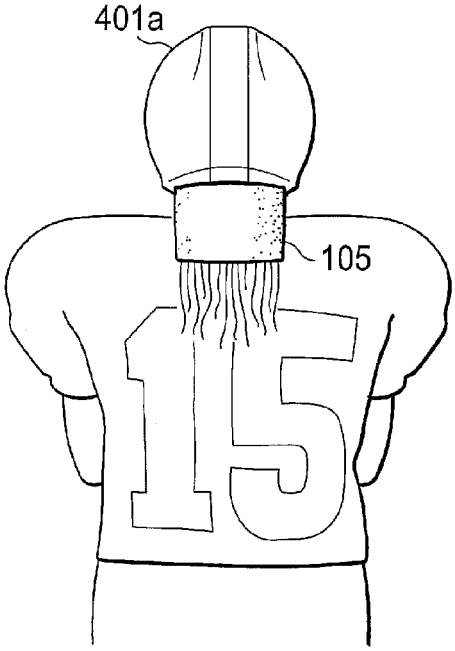
FIG. 6 is a back view of the headgear being worn beneath a helmet permitting hair to extend beyond a back opening.

Referring now also to FIG. 6, headgear 101 of the preferred embodiment permitting long hair to extend beyond back opening 109 is illustrated. In the preferred embodiment, elongated hair covering 105 can be any length, though typically extending the full length of the hair. However, it is understood that other embodiments may allow for hair to be exposed beyond back opening 109. For example, length L of tail portion 106 may be 20, 15, or 10 inches in length irrespective of the hair length. As seen in FIG. 6, a helmet 401*a* used by a football player is worn over headgear 101 permitting hair to extend beyond back opening 109. In the preferred embodiment, the user may cut elongated hair covering 105 to any length desired. For example, if the user cuts their hair shorter, the user may cut off a portion of elongated hair covering 105 to match the length of the hair. The profile of the cut may be of any design including, but not limited to zigzag, triangular, or wavy for example. Depending on the material used in elongated hair covering 105, stitching the cut edge may not be required.

Furthermore, it is understood that elongated hair covering 105 may be lengthened by adding additional fabric. The additional fabric may be attached to elongated hair covering 105 by stitching or the use of fasteners that permit re-use and interchangeability such as, but not limited to buttons, snaps, VELCRO, or zippers to name a few.

Surrounding the hair is also a safety feature of the preferred embodiment. Hair is prevented from blowing in the face of a user wherein the hair could cause distractions. For example, hair may be blown into the eyes causing the operator of equipment to automatically shut the eyes. This automatic reaction is a distraction that may lead to eye damage or an accident while operating equipment. Furthermore, physical damage to the hair or scalp is avoided from hair being caught or snagged in mechanical or stationary equipment or caught on fire due to the loose hair contacting sparks. Additionally, when hair extends under a head covering, the head covering is more easily pulled off the head as hair is blown in the wind or pulled upward. Sudden and unexpected removal of a head covering in such a situation can lead to the dangers listed above. Headgear 101 largely avoids this problem by being configured to accept the hair within elongated hair covering 105. In doing so, band portion 103 surrounds the hair rather than permitting the hair to lie under band portion 103. Therefore headgear 101 is more secure and safe around the head than other head coverings.

Although elongated hair covering 105 is depicted as being made from two pieces of fabric, it is understood that headgear 101 may be created from one or more pieces of fabric. Therefore, headgear 101 may have any number of seams, including zero, from the joining of multiple ends of fabric. For example, if two pieces of fabric is used, typically there are two seams. However, another example would have no seams if the fabric was formed or created in a tubular shape.

Figure 7:
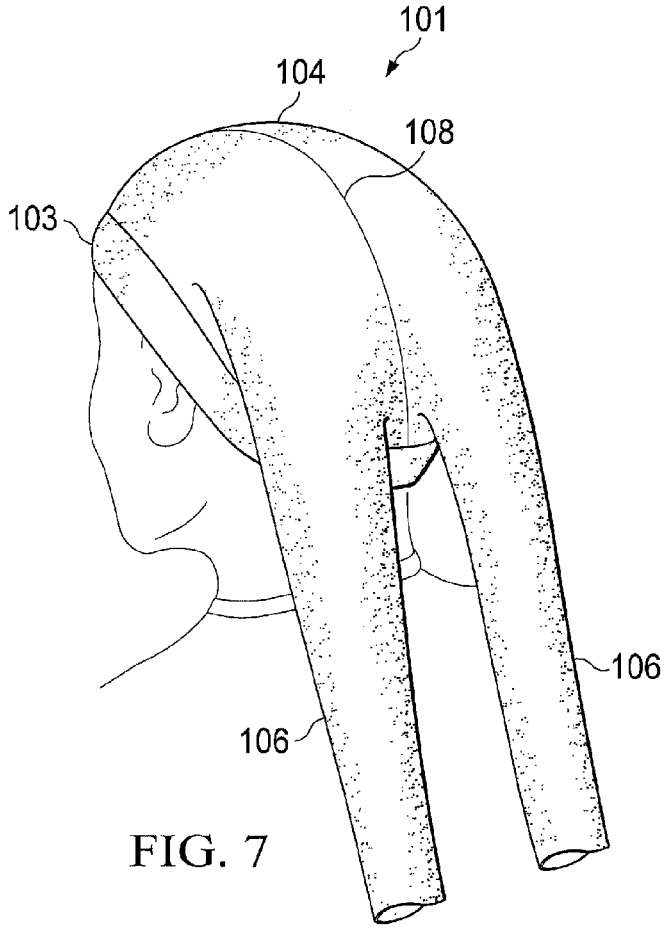
FIG. 7 is a back view of the headgear skull cap of FIG. 1 having multiple tail portions for dividing the hair.

Referring now also to FIG. 7, another embodiment of headgear 101 is illustrated having multiple tail portions 106 extending from head portion 104. Each tail portion 106 would have the features and characteristics associated with a single tail portion 106 in the preferred embodiment. Elongated hair covering 105 may have head portion 104 and multiple tail portions 106 or have multiple tail portions 106 attached directly to band portion 103. For example, each tail portion 106 could be attached to a portion of band portion 103 and to another tail portion 106 along a center stitch line 108. Although stitching or sewing has been used to describe a method of attaching two or more pieces of fabric, it is understood that other methods of attaching fabric are possible, such as but not limited to: applying heat or pressure using some form of glue or adhesive, buttons, snaps, clips, zippers, and hook and loop-type fasteners, such as VELCRO, to name a few.

It should also be understood that any type fabric or other material may be used to create and or attach to headgear 101, whether to surround hair or not. Any color may be used. Decorations, such as but not limited to ribbons or beads for example, may be attached at any place on headgear 101 to give artistic, ornamental, or decorative design to headgear 101. Furthermore, material having promotional indicia may be used anywhere on headgear 101. For example, band portion 103 may be purchased from third party manufacturers containing graphical and textual indicia.

Figure 8:
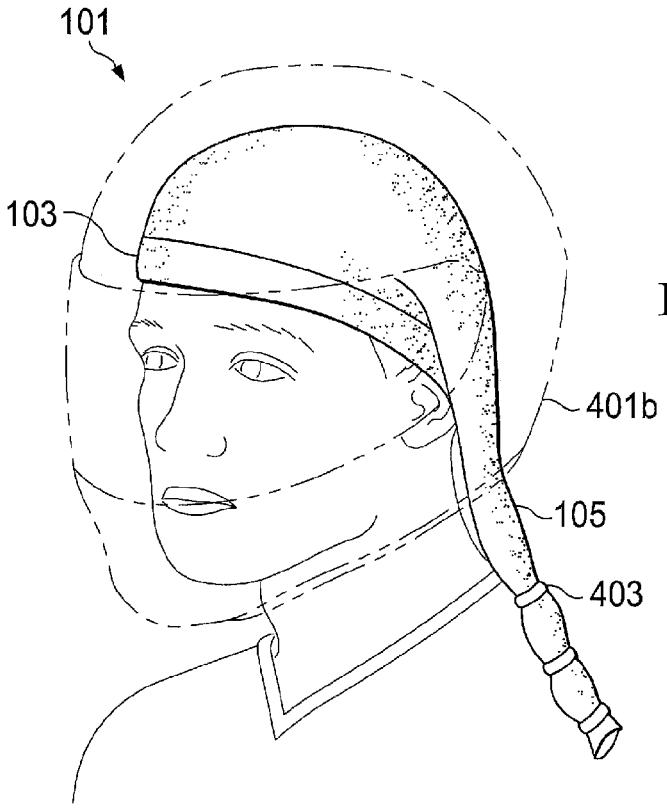
FIG. 8 is a front quartering view of the headgear of FIG. 1 worn beneath a helmet, using hair fasteners to secure the hair below the helmet line.
Figure 9:
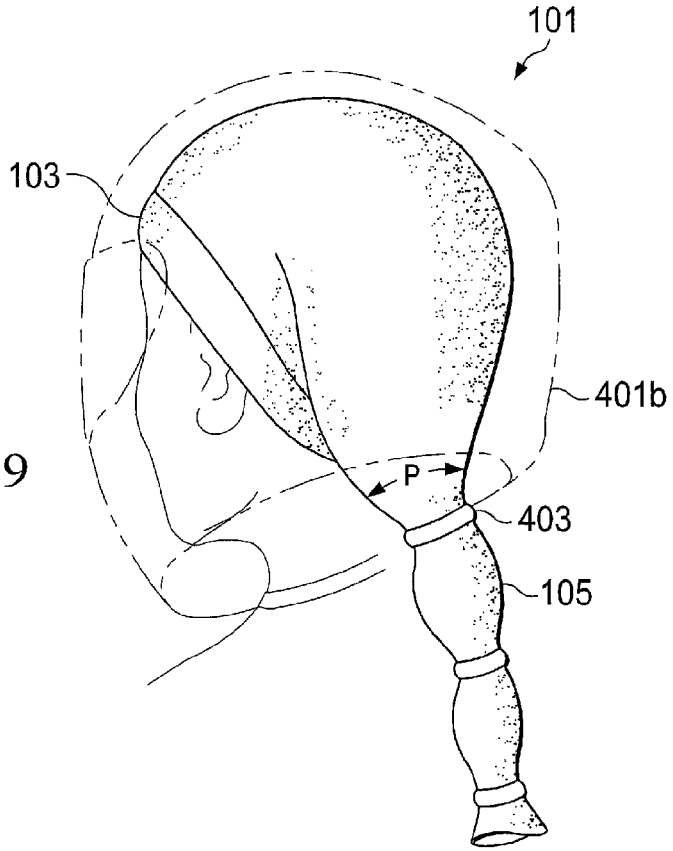
FIG. 9 is a back quartering view of the headgear of FIG. 8.

Referring now also to FIGS. 8 and 9, a front and back quartering view of headgear 101 being worn beneath helmet 401*b* is illustrated. Helmet 401*b* is depicted as a type of head apparatus for description of the preferred embodiment. The safety features and advantages of the preferred embodiment apply to all types of head apparatuses and is not limited only to helmet 401*b* depicted in the drawings. For example, it is understood that other head apparatuses are, but not limited to, masks, goggles, or facial shields to name a few.

Headgear 101 is designed to allow for configuration flexibility. Configuration flexibility refers to the ability of headgear 101 to permit the user the flexibility to gather the hair in any hairstyle and at any location on the head. For example, a ponytail can be positioned at any location on the head such as but not limited to: on the crown of the head or lower neck. Additionally, braids, buns, pigtails, dreadlocks, and afros are further examples of hairstyles that may be used with headgear 101. The configuration flexibility of elongated hair covering 105 allows the hair to be protected irrespective of the length, hairstyle, or location of the hair. A separate hair fastener 403 can be used around the hair individually, meaning inside elongated hair covering 105; or collectively with headgear 101, meaning both the hair and elongated hair covering 105 are gathered by hair fastener 403. Hair fasteners 403 may be any type of material or device which grips, squeezes, clamps, confines, or holds hair. Such examples may be, but are not limited to a scrunchie, elastic, hair clips, hair ties, and pins to name a few. Hair fasteners 403 may be used at any location on headgear 101. Although headgear 101 does not require the use of hair fasteners 403, any number of hair fasteners 403 may be used on any portion of headgear 101. Additionally, although described using separate hair fasteners 403, it is understood that other embodiments may use one or more hair fasteners 403 integrated and incorporated into elongated hair covering 105.

Additionally, as seen in FIGS. 8 and 9, the configuration flexibility of headgear 101 is designed to provide and promote safety. Typically, helmet 401*b* or other head apparatuses limit the type of hairstyle in order to allow the head apparatus to fit securely, safely, and comfortably on a head. For instance, if hair is gathered or bunched under helmet 401*b*, helmet 401*b* generally does not fit properly, and unsafe discomfort may be experienced by the user. The configuration flexibility of headgear 101 not only permits the adaptation of multiple hairstyles to a variety of head apparatuses; but headgear 101 also protects and contains the hair while fitting securely and comfortably on the head.

For example, the configuration flexibility of headgear 101 permits hair inside elongated hair covering 105 to remain loose while remaining protected. By permitting a loose fit, elongated hair covering 105 flattens, thereby allowing the hair to spread apart. This broadly loosens and displaces the hair in a direction P. Therefore, elongated hair covering 105 and the hair lay relatively flat under helmet 401*b*. This is made possible partly due to the stretchable characteristics of the fabric and size of elongated hair covering 105 as denoted by width D in FIG. 1. This positioning removes the discomfort and permits helmet 401*b* to sit securely and safely on the head. Hair fastener 403 may still be used to secure the long hair in tail portion 106. For example, hair fastener 403 could be slid down tail portion 106 toward back opening 109*a* distance, such as six inches. In this example, hair is made loose thereby permitting the hair to lie relatively flat under helmet 401*b* for safety, but remains gathered at the end via hair fastener 403 for protection.

Figure 10A:
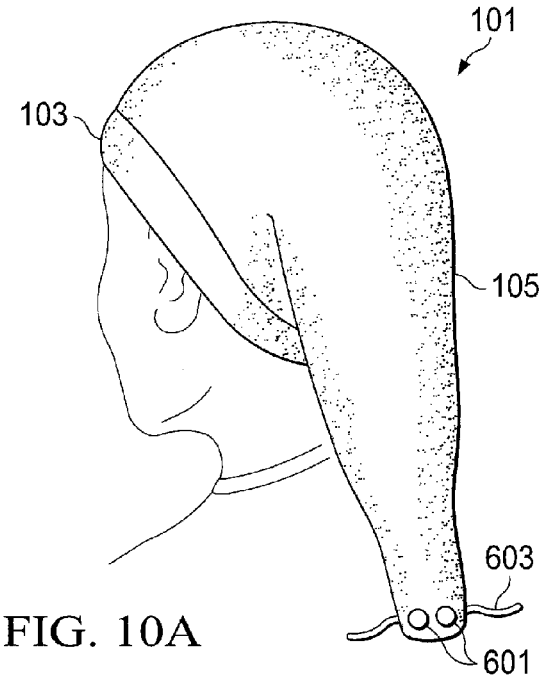
FIGS. 10A and 10B are quartering views of an alternate embodiment of FIG. 1 where headgear has a tie strap and a closure member.
Figure 10B:
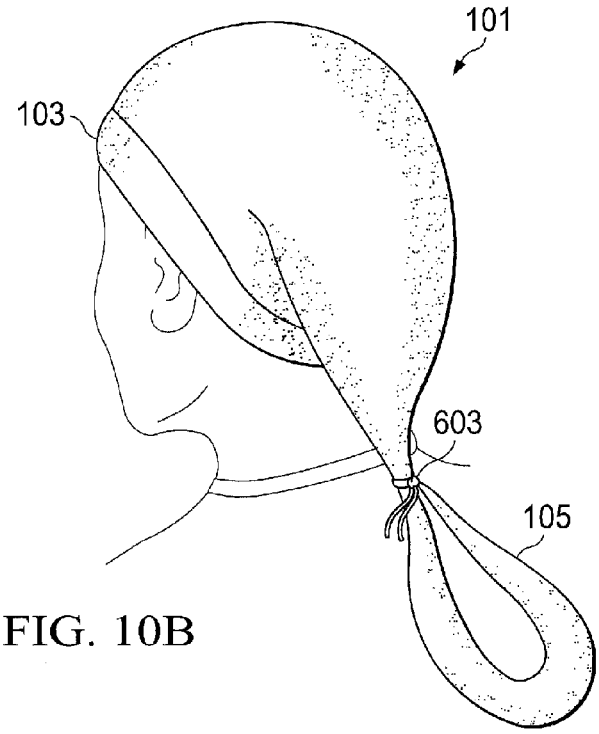

Referring now also to FIGS. 10A and 10B, headgear 101 having a closure member 601 and a tie strap 603 of the present application is illustrated. In the preferred embodiment, back opening 109 is open thereby allowing a user to reach through. It is understood that other embodiments may allow for back opening 109 to open or close, thereby fully enclosing the hair. This may be done by adding hair fastener 403 as described above, being integrated into elongated hair covering 105, or by using some closure members 601 as seen in FIG. 10A. Examples of closure members 601 which may be used, but not limited to, are snaps, buttons, or zippers to name a few. Closure members 601 would preferably be located in close proximity to back opening 109 on tail portion 106. For example, use of elastic at back opening 109 may be used to severely restrict width D serving to close back opening 109. Access inside tail portion 106 is granted by spreading apart the elastic. Furthermore, closure member 601 may be one or more buttons as illustrated in FIG. 10A. Although elongated hair covering 105 is described as having back opening 109, another embodiment allows for back opening 109 to be completely closed, by stitching fabric together for example.

Furthermore, it is understood that an alternate embodiment can use a tie strap 603 to raise and secure back opening 109 to any location on headgear 101 as seen in FIG. 10B. Tie strap 603 may include flexible elongated material or other materials or devices that would support and secure the weight of the hair to headgear 101 such as, but not limited to clips and pins for example. One or more tie straps 603 can be used. Typically tie strap 603 is located near back opening 109, but any location on headgear 101 is possible. Tie straps 603 can both fasten back opening 109 to headgear 101 and/or close back opening 109.

For example, tie strap 603 could be a drawstring wherein such drawstrings could be used both as closure member 601 and as tie strap 603. Although specific embodiments were described, it is understood that other methods of adjusting the size of back opening 109 and securing it to headgear 101 may be used. Although described as securing back opening 109 to any location on headgear 101 by using tie strap 603, it is understood that tie strap 603 may serve to secure back opening 109 to any garment of clothing on the user or to any object in the surrounding area.

To wear headgear 101, the user must follow a number of steps. These steps are a representation of a process to follow and are in no way meant to be the exclusive way to operate headgear 101. The hair is first placed in a loose ponytail using hair fastener 403. Band portion 103 is then placed around the head wherein a hand reaches up through back opening 109 and grabs the base of the ponytail. The hand pulls the hair and hair fastener 403 through elongated hair covering 105 as the hand is being removed from back opening 109, wherein hair fastener 403 is also removed. It is understood that a user may prefer to leave hair fastener 403 inside elongated hair covering 105 rather than removing hair fastener 403. Attach the desired number of hair fasteners 403.

The current application has many advantages over the prior art including the following: (1) ability to secure, protect, and circumferentially surround long hair; (2) to permit the configuration flexibility to cover hair of multiple styles; (3) may be worn with full custom fitted helmets; (4) safely permit comfortable and proper wearing of head apparatuses with long hair inside a head covering; (5) ability to surround long hair and permit the hair to lay flat against the neck; (6) allow the user to vary the type and location of hairstyles while remaining protected; (7) flexibility to open and close back opening 109 using closure members 601 or tie straps 603; (8) flexibility to temporarily tie up the hair using tie straps 603; (9) can be used without tie straps; (10) can be used in sporting activities, leisure activities or occupational activities; (11) surrounds multiple types and styles of hair such as dreadlocks, afro, long, or frizzy hair; (12) surrounds the hair within elongated hair covering 105 thereby preventing hair that is blown in the wind, or pulled, from removing the head covering; (13) fast to put on and take off; (14) does not pull out hair; (15) remains on the head during sports involving high speeds; and (16) allows a user to lengthen or shorten elongated hair covering 105 to any length desired.

The particular embodiments disclosed above are illustrative only, as the application may be modified and practiced in different but equivalent manners apparent to those skilled in the art having the benefit of the teachings herein. It is therefore evident that the particular embodiments disclosed above may be altered or modified, and all such variations are considered within the scope and spirit of the application. Accordingly, the protection sought herein is as set forth in the description. It is apparent that an application with significant advantages has been described and illustrated. Although the present application is shown in a limited number of forms, it is not limited to just these forms, but is amenable to various changes and modifications without departing from the spirit thereof.

What is claimed is:

1. A method of installing a head covering, the method comprising:

gathering a quantity of hair on a head;

securing a head covering around the head, the head covering comprising a band portion and an elongated hair covering attached to the band portion, the elongated hair covering comprising a head portion extending from the band portion, as a curved tube of length greater on one side of the curved tube than on an opposite side of the curved tube, to a tail portion extending as a closed tube from the head portion to a distal edge defining a free open end, such that the band portion of the head covering is secured around the head, with the gathered quantity of hair disposed within the head portion and the head portion positioned snuggly against the sides and top of the head;

reaching into the secured head covering through the free open end to grasp the gathered quantity of hair; and then pulling the grasped quantity of hair through the elongated hair covering, thereby positioning the pulled quantity of hair along the tail portion of the elongated hair covering with the tail portion of the head covering surrounding the positioned hair and extending down the back of the wearer.

2. The method of claim 1, wherein the band portion comprises a stretchable fabric such that, with the head portion positioned snuggly against the sides and top of the head the band portion is in a stretched condition.

3. The method of claim 1, wherein the head portion comprises a stretchable fabric such that, with the head portion positioned snuggly against the sides and top of the head the head portion is in a stretched condition.

4. The method of claim 1, further comprising, after pulling the grasped quantity of hair through the elongated hair covering, fastening a closure member proximate the free open end of the tail portion of the elongated hair covering.

5. The method of claim 1, wherein the tail portion is one of multiple discrete tail portions extending separately from the head portion.

6. The method of claim 1, wherein the tail portion is smaller in circumference at the free open end than at the head portion.

7. The method of claim 1, wherein the circumference of the tail portion gradually decreases from the head portion to the free open end.

8. The method of claim 1, wherein the head portion increases in circumference from the band portion to a maximum circumference, and decreases in circumference from the maximum circumference to the tail portion.

9. The method of claim 1, wherein the tail portion extends as a closed tube of varying circumference from the head portion to the free open end.

10. The method of claim 1, wherein the tail portion is smaller in circumference at the free open end than at the head portion.

11. The method of claim 1, wherein the tail portion has a length of 10, 15 or 20 inches.

* * * * *